United States Patent [19]

Ban et al.

[11] 4,111,755

[45] Sep. 5, 1978

[54] METHOD OF PRODUCING PELLETIZED FIXED SULFUR FUEL

[75] Inventors: Thomas E. Ban, South Euclid; Ashok D. Rao, Euclid, both of Ohio

[73] Assignee: McDowell-Wellman Engineering Company, Cleveland, Ohio

[21] Appl. No.: 763,226

[22] Filed: Jan. 27, 1977

Related U.S. Application Data

[63] Continuation-in-part of Ser. No. 627,240, Oct. 30, 1975, abandoned.

[51] Int. Cl.[2] ..... C10B 53/08; C10B 57/06; C10B 57/10

[52] U.S. Cl. ..... 201/6; 44/1 F; 110/342; 110/345; 201/8; 201/17; 201/20

[58] Field of Search ..... 201/5, 6, 7, 8, 17, 201/20; 44/1 R, 1 F; 110/1 H, 1 J

[56] References Cited

U.S. PATENT DOCUMENTS

| | | | |
|---|---|---|---|
| 191,530 | 6/1877 | Hornbostel | 110/1 J |
| 2,025,882 | 12/1935 | Michot-Duport | 201/20 |
| 2,955,991 | 10/1960 | Tufty | 201/5 |
| 3,481,834 | 12/1969 | Squires | 201/5 |
| 3,540,387 | 10/1968 | McLaren et al. | 110/1 J |
| 3,823,676 | 7/1974 | Cook et al. | 110/1 J |
| 3,907,648 | 9/1975 | Nire et al. | 201/6 |

FOREIGN PATENT DOCUMENTS

| | | | |
|---|---|---|---|
| 222,890 | 7/1925 | United Kingdom | 201/20 |

*Primary Examiner*—Morris O. Wolk
*Assistant Examiner*—Bradley Garris
*Attorney, Agent, or Firm*—McNenny, Pearne, Gordon, Gail, Dickinson & Schiller

[57] ABSTRACT

A fixed sulfur fuel is produced by proportioning sulfur-bearing coal and limestone in amounts which will cause the calcium in the limestone to react with a large amount of sulfur in the coal. The proportioned mixture is ground and blended and then balled or compacted to form pellets. By means of either a carbonizing or pyrolyzing technique conducted in a traveling grate machine, where the pellets are heated to at least 800° F., the coal is pyrolyzed or carbonized, the limestone is calcined, and the sulfur is fixed in a calcium compound which remains stable in the ash after the pellets are burned as a fuel.

13 Claims, 2 Drawing Figures

METHOD OF PRODUCING PELLETIZED FIXED SULFUR FUEL

This is a continuation-in-part of U.S. patent application Ser. No. 627,240, filed Oct. 30, 1975, and now abandoned.

BACKGROUND OF THE INVENTION

Combustion of coal can cause considerable air pollution from sulfur oxides and particulates of carbon and uncombusted, condensable hydrocarbons commonly referred to as "smoke." There are methods of suppressing the pollutants, but those techniques are primarily directed to methods of capturing the sulfur chemically or mechanically after high-sulfur coal is burned and before it leaves the stack. Another technique may be found in U.S. Pat. Nos. 2,824,047; 2,927,063; and 3,117,918, where the patentees mix carbonaceous solid fuels containing sulfur with a solid material capable of absorbing $H_2S$. The mixture is treated with hydrogen gas at a temperature of above 1100° F. whereby the hydrogen gas combines with the sulfur to form $H_2S$. The $H_2S$ is absorbed in situ by the $H_2S$ acceptor. Such methods are costly and even though the United States has abundant deposits of high-sulfur coal, environmental regulations prohibit the burning of high-sulfur coal without adequate treatment of the gases.

Coal is very complex carbonaceous fuel containing various percentages of carbon, hydrogen, and sulfur fuel constituents, along with minor parts of oxygen, nitrogen, and ash as nonfuel mineral matter. Under conditions of high temperature pyrolysis, the coal is cracked or decomposed into solid, liquid, and gaseous constituents as coked residues, coal oils, and coal gases. The coal oils and coal gases arise from the volatile matter of coal, and under conditions of combustion the volatile matter can cause condensable smoke as an air pollutant. Sulfur in coal largely originates from (1) pyrite, $FeS_2$, an inorganic mineral of coal ash and (2) organic sulfur compounds such as mercaptans and thiophenes. Under conditions of pyrolysis, the organic sulfur compounds decompose to low density, gaseous sulfides and high-temperature conversion of pyrite, $FeS_2$, produces elemental sulfur and FeS, the more stable form of pyrite. These subsequently react with hydrogen and CO of pyrolysis to form $H_2S$, COS, and some heavier organo-sulfur gases.

SUMMARY OF THE INVENTION

This invention relates to a fixed sulfur fuel which is a highly upgraded material with many beneficial aspects with respect to its use as a source of energy from combustion or as a reagent for gasification. This fuel is pelletized coal, or pellet coke, and is produced by pyrolyzing balled mixtures of fine coal with limestone and/or alkaline oxides at high temperatures within a reducing or slightly oxidizing environment to cause simultaneous high-temperature decomposition of the hydrocarbonaceous matter of coal and calcination with sulfur fixation of the basic constituents.

More specifically, sulfur-bearing coal and limestone are proportioned in amounts which will cause the calcium in the limestone to react with a large amount of sulfur in the coal. The proportioned mixture is ground and blended and then balled or compacted to form pellets. Those pellets are then subjected to either a carbonizing or pyrolyzing technique at a temperature of at least 800° F., and preferably between 1200° F. and 2200° F. These techniques are carried out on a traveling grate machine. If a pyrolyzing technique is employed, the firing operation is carried out in a reducing atmosphere, and preferably on a sealed, circular traveling grate machine of the type shown in U.S. Pat. No. 3,302,936. If a carbonization technique is employed, air is admitted to the firing zone and the firing operation need not be conducted in a sealed atmosphere. In either case, however, the presence of large amounts of carbon ensures a reducing condition in the traveling bed. During the firing operation, the limestone is calcined and the sulfur is fixed in a calcium compound which becomes stabilized in the ash after the pellet is burned as a fuel.

DETAILED DESCRIPTION OF THE INVENTION

A sequence of processing steps is required for the production of pelletized coal. In a continuous operation, these involve (1) proportioning, (2) grinding-blending, (3) balling, and (4) pyrolyzing or carbonizing. The pyrolyzing operations are carried out as a continuous sequence of drying, firing, and cooling, and the carbonizing operations are carried out as a continuous sequence of drying and firing. The overall intent of the pelletizing operation is to co-react limestone particles with coal particles during pyrolysis or carbonizing so as to cause sulfur to react and fix with the lime while the coal is undergoing pyrolytic decomposition. The overall pyrolyzing process is illustrated in FIG. 1.

Figure 1:
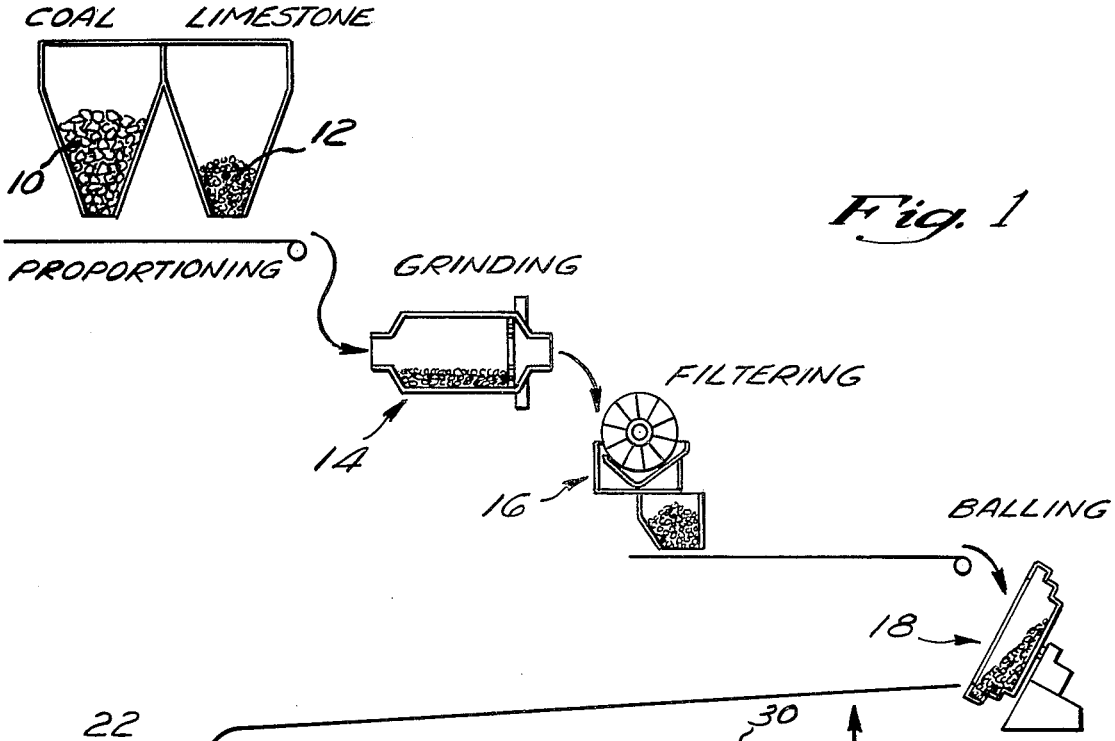
FIG. 1 is a schematic flow sheet of a procedure for producing pellet coke with a high fixed sulfur content by a pyrolyzing technique.

Referring now to FIG. 1, coal 10 and limestone 12 are proportioned in a ratio which is derived from about 1 to 3 parts of CaO per part of sulfur in the coal, i.e., coal containing 2.5% sulfur requires an addition of 2.5% to 7.5% of CaO or 5–15% limestone which contains 50% CaO within the stone as $CaCO_3$. Proportioning in a continuous system can be made by continuous weighing feeders which are adjusted to conform to the above ratio.

After proportioning, the two raw materials are conveyed to a grinding and blending station 14. The two raw materials are ground and intimately blended to enable a final size structure which is suitable for balling or compacting and to provide an intimate mixture of very fine particles which enables sulfur-fixation reactions to take place. Usually, a size structure of approximately −65 mesh is satisfactory for carrying out both phenomena. A number of approaches can be used for grinding and blending to provide a moist blend for balling. For example, one such technique is wet-circuit grinding, wherein both coal and limestone in their natural states are wet-ground and blended together in a ball mill with water, and a slurry is filtered to a filter cake by vacuum filtration. Another technique involves dry-circuit grinding, wherein the coal and limestone are dried together or separately and co-mixed during the grinding in a dry ball milling circuit. Still another technique involves wet and dry-circuit grinding, wherein one of the raw materials, such as coal, can be wet-ground and filtered and blended with dry-ground limestone within a muller or pug mill arrangement.

After grinding, the mixed coal and limestone is filtered at a filtering station 16 and then the material is conveyed to a balling or compacting station 18. The moistened blend of ground coal and limestone is balled in a rotary pan or drum, such as the rotary pan or drum shown in U.S. Pat. No. 3,060,496. Small quantities of additional water are added to produce discrete balls approximately one-half inch in diameter. Alternate methods of compacting could include briquetting or extruding the coal-limestone blend.

The green balls are then transferred to the charging chute 20 of a traveling grate machine 22. The traveling grate machine 22 is adapted to carry out a pyrolyzing operation and such a machine is shown in detail in U.S. Pat. No. 3,302,936, the subject matter of which is incorporated herein by reference. The pellets are conveyed along a grate 24 through a drying zone 26. In the drying zone, the pellets are subjected to a downdraft of gases of pyrolysis taken from a cooling zone 28 through a suitable conduit 30 and sucked through the traveling bed of pellets by a blower 32.

From the drying zone 22, the pellets are conveyed to a firing zone 34, where the pellets are subjected to a downdraft at a temperature exceeding 800° F., and preferably within the range of 1200° to 2200° F. Air is employed as a fuel and is admitted to the firing zone generally as indicated by the arrow 36. The downdraft is caused by suction produced by a blower 38 and reaction gases from the firing zone 34 are recovered and condensed in a liquid hydrocarbon recovery system 40. In the firing zone a number of reactions take place. It should be appreciated that calcium carbonate is the predominant compound of limestone and under the high temperature conditions of pyrolysis and combustion, it converts to reactive CaO and $CO_2$. Hot CaO has a high affinity for sulfur in the reduced or oxidized state. Some reactions which occur from pyrolysis of coal-limestone pellets which tend to fix the sulfur are:

$$FeS + CaO + C \rightarrow Fe + CO + CaS$$

$$H_2S + CaO \rightarrow H_2O + CaS$$

$$COS + CaO \rightarrow CO_2 + CaS.$$

Under oxidizing conditions, CaS as "fixed" sulfur can form stable $CaSO_4$, as follows:

$$CaS + 2O_2 \rightarrow CaSO_4.$$

This can also retain sulfur in the "fixed" state.

The pulverant coal and limestone react during pyrolysis of pellet blends, while the coal converts to a semi-liquid-like paste. The mobility of the liquid as caused by evolving gases allows sulfur units to mix with the nascent lime and react at rapid rates. The refractory nature of the lime tends to "kill" the ordinary high-foaming swelling characteristics of the coal particles, and the $CO_2$ of calcination tends to oxidize the plastic mass and further minimize the swelling characteristics. This benefits the pyrolysis reactions, and enables bits of pellets to maintain permeability. As the gases and liquids evolve, the pellet acquires a frozen foam, cokelike, gossamer-celled microporous structure with interspersed lime-ash particles. Though CaO in the form of limestone is proposed as the primary reagent for fixing sulfur, it is apparent that other basic materials, such as magnesium carbonate, sodium carbonate, and potassium carbonate, can be substituted alone or in combination for some or all of the CaO in amounts which would provide similar sulfur fixation characteristics, as compared to the replaced CaO, since those replacing compounds are equivalent to CaO for the purposes contemplated herein.

The total time that the pellets are subjected to the firing operation is preferably maintained at a time period of less than one hour to ensure that the pellets will be free of any significant amounts of graphite. The presence of graphite greatly reduces the efficiency of the pellets when they are combusted as a fuel.

The pellets are then conveyed to the cooling zone 28, where they are subjected to a cooling updraft from the blower 38 at ambient temperatures. The gases of pyrolysis are partially recycled to the drying zone and are partially vented to atmosphere. As the pellets cool, they retain the spherical ball shape, and in some cases they are mildly bloated. The cooled pellets, depleted of hydrocarbons and gases, and substantially free of graphite, are hard and thermally "indestructible." This is an ideal structure and condition for a carbon source to be used as, for example, stoker fuel or fixed bed fuel for a gas producer.

A typical run for pyrolyzing coal and limestone to fix the sulfur is set forth in Table I as follows:

TABLE I

| | |
|---|---|
| Size analysis | |
| Coal | −65 mesh |
| Limestone | −100 mesh |
| Composition of blend | |
| Coal | 80.0% |
| Limestone | 20.0% |
| Size of green pellet | $-\frac{3}{8}'' + \frac{1}{2}''$ |
| Moisture content | 20.0% |
| Bed depth | 12.0 in. |
| Pyrolyzing techniques | |
| a) Method | traveling grate |
| b) Firing cycle | |
| Drying | |
| Time | 10 min. |
| Temperature | 400° F. |
| Draft rate | 350 SCFM/Ft$^2$ |
| Firing | |
| Downdraft | |
| Time | 20 min. |
| Temperature | 1700° -2100° F. |
| Draft rate | 200 SCFM/Ft$^2$ |
| Updraft | |
| Time | 5 min. |
| Temperature | Ambient |
| Draft rate | 30 SCFM/Ft$^2$ |

The results obtained from such a technique employed on two different type coals are set forth in Tables II and III as follows:

TABLE II

Coal analysis:
FC = 52 - 61%
VM = 23 - 39%
Ash = 9 - 17%
S = 1.7 - 2.3%

Limestone analysis:
$CaCO_3$ = 95 - 97%
Gangue = 3 - 5%

| | Green Pellet Blend -% | Carbonized Pellets % | Combusted Carbonized Pellets -% | Gasified Carbonized Pellets-% |
|---|---|---|---|---|
| VM | 27.19 | 1.84 | 0.0 | 0.0 |
| FC | 49.17 | 55.96 | 5.22 | 6.00 |
| Ash | 24.64 | 42.20 | 94.78 | 94.00 |
| S | 1.35 | 1.39 | 2.65 | 2.09 |
| Weight % | | | | |
| Solids | 100.00 | 58.38 | 25.99 | 26.21 |
| Units S | | | | |
| solids | 1.35 | 0.81 | 0.69 | 0.55 |
| gases | | 0.54 | 0.12 | 0.26 |
| Percent of original S | | | | |
| solids | 100.00 | 60.0 | 51.1 | 40.7 |
| gases | | 40.0 | 8.9 | 19.3 |

TABLE III

Blend: 80 parts coal (dry); 20 parts limestone (dry)
Balled, pyrolyzed, and combusted

| Coal analysis: | Limestone analysis: |
|---|---|
| FC = 48 - 56% | CaCO = 95 - 97% |
| VM = 30 - 34% | Gangue = 3 - 5% |
| Ash = 11 - 22% | |
| S = .4 - .6% | |

| | Green Pellet Blend -% | Pyrolyzed Pellets % | Combusted Pyrolyzed Pellets -% |
|---|---|---|---|
| VM | 32.46 | 5.09 | 0.0 |
| FC | 38.62 | 52.45 | 1.58 |
| A | 28.96 | 42.46 | 98.42 |
| S | 0.36 | 0.50 | 0.60 |
| Weight % | | | |
| Solids | 100.0 | 68.2 | 29.43 |
| Units S | | | |
| solids | 0.360 | 0.341 | 0.176 |
| gases | | 0.019 | 0.165 |
| Percent of original S | | | |
| solids | 100.0 | 94.7 | 48.9 |
| gases | | 5.3 | 51.1 |

It may be noted that in Table II a significant amount of the sulfur is fixed and that 51.1% of the original sulfur is left in the ash rather than being vented to the atmosphere as $SO_2$. In Table II, as much as 94.7% is left in the ash, while only 5.3% is vented to the atmosphere.

The fixed sulfur fuel may be produced by a carbonizing technique rather than a pyrolyzing technique. In a carbonizing technique, the traveling grate machine need not be sealed, and air is forced through the traveling bed by a blower. While the atmosphere in the traveling grate may be considered as semioxidizing, the individual particles are surrounded by a reducing atmosphere because of the large amounts of carbon involved in the reactions.

Figure 2:
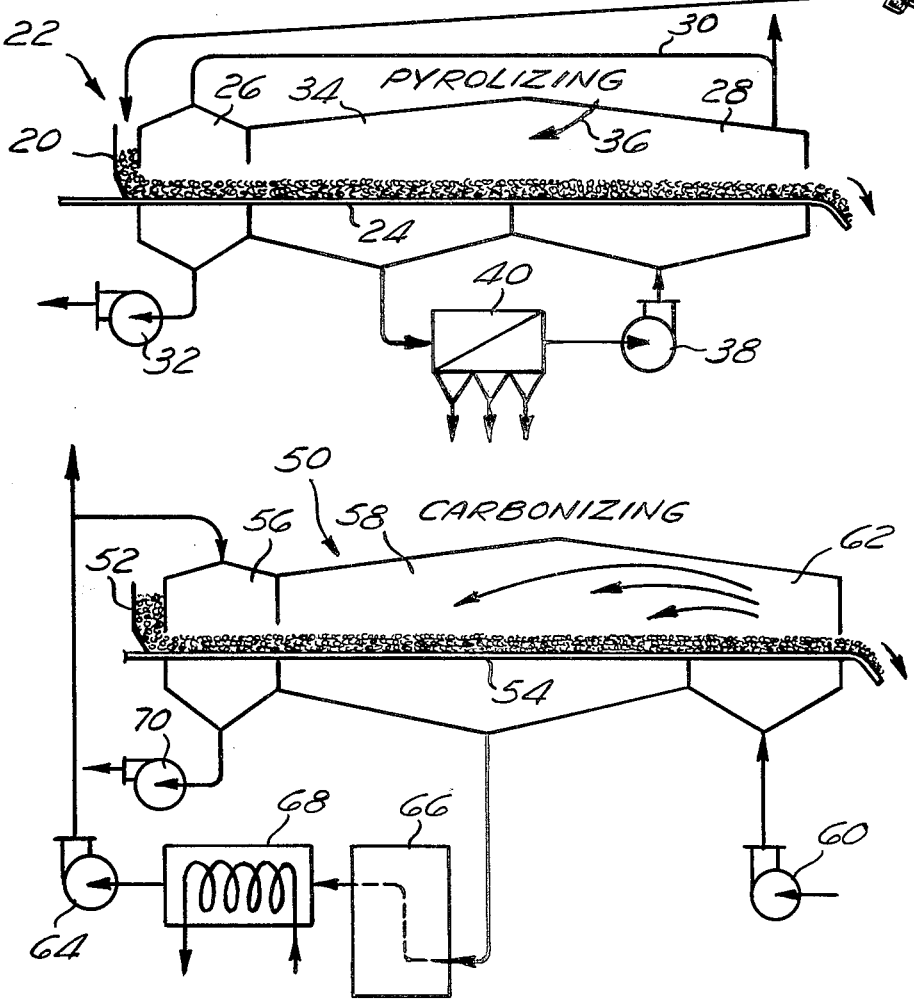
FIG. 2 is a schematic flow sheet showing the production of pellet coke with high fixed sulfur content by a carbonizing technique.

Referring now to FIG. 2, a carbonizing technique is shown. In that figure, there is illustrated a traveling grate machine 50 having an inlet opening 52 which receives green pellets from the balling station 18. The pellets are deposited upon a traveling grate 54 and successively conveyed through a drying zone 56 and a firing zone 58. Air is updrafted through the bed in the firing zone by a blower 60, which forces air through a terminal combustion zone 62. The air is downdrafted through the bed in the firing zone and is drawn therefrom by a blower 64 after passing through an afterburner 66 and a boiler 68. Some of this gas is then downdrafted through the drying zone 56 by a blower 70.

The pelletized coal produced according to the foregoing procedures is a highly upgraded fuel and has many beneficial features. It is depleted of hydrocarbonaceous matter (volatile matter); hence (a) it can be stored without problems of spontaneous combustion, (b) it can be pulverized without tendencies toward dust explosions, and (c) it can be burned or gasified without evolution of tar fogs or deposition of soot. It is of a size pellet structure as hardened one-quarter inch to three-quarter inch spheres of agglomerated carbon which (a) handle and flow readily from bins, stockpiles, and furnace columns, and (b) have substantial porosity and bed in columns with uniform permeability for the gas-solid reactions of combustion and gasification. It is thermally stable (relatively unaffected structurally by heat) and has none of the original swelling and softening properties of coal; hence, it can be applied to combustion and gasification furnaces without obstruction of the gas-solid reactions. It has the sulfur largely fixed by basic oxides to the ash constituents of coal after combustion as a fuel; hence, it can be used for gasification and combustion with major diminution of sulfur emanation in the gaseous state.

The unusual structure of the pellet coke undergoing oxidation as a fuel is believed to cause the marked sulfur fixation. As the pellet of homogeneous ash and lime composition oxidizes, the surface of the pellet immediately acquires a reactive powdery film of high lime ash. The sulfur and carbon compounds emanating from the interior of the pellet pass through the film and are sorbed therein. As oxidation continues, the film becomes thicker and hotter, increasing its sorptive powers. Final oxidation of the ash causes sulfatization of the fixed sulfur, which renders it inert with respect to weathering and prevents the formation of $H_2S$, which would occur if the sulfur were present in the form of a sulfide.

Analyses of the forms of sulfur present in samples of green pellets, pellet coke and ash obtained from both combustion and gasification tests are presented in the following table:

TABLE IV

| | Percentage by Weight | | |
|---|---|---|---|
| | Total S | S++ | S as $SO_4$ |
| Green pellet | 2.50 | 2.25 | 0.25 |
| Pellet coke | 2.68 | 2.52 | 0.16 |
| Ash (combustion) | 3.29 | 0.01 | 3.28 |
| Ash (gasification) | 2.33 | 1.29 | 1.04 |

What is claimed is:

1. A method of producing pelletized, fixed sulfur oxidation fuel and for producing ash having sulfur fixed therein consisting essentially of the steps of preparing an intimate mixture, said mixture consisting essentially of a particulate coal containing sulfur and hydrocarbonaceous volatile matter and a basic material, forming the mixture into pellets, heating said pellets to a temperature exceeding about 800° F. to cause substantial depletion of the hydrocarbonaceous volatile matter, calcination of the basic material, and fixation of at least some of the sulfur as a sulfide of the basic material, and converting the sulfide to a sulfate by burning said pellets as a fuel under oxidizing conditions thereby producing ash having sulfur fixed therein.

2. A method according to claim 1, wherein said pellets are heated at said temperature exceeding about 800° F. in a reducing environment.

3. A method according to claim 1, wherein said temperature is between about 1200° F. and 2200° F.

4. A method according to claim 1, wherein said temperature is between 1700° F. and 2100° F.

5. A method according to claim 1, wherein said pellets are discrete balls having a diameter of about ½ inch.

6. A method according to claim 1, wherein the time at which the pellets are held at said temperature is less than 1 hour.

7. A method according to claim 1, wherein said basic material is CaO present in the form of limestone.

8. A method according to claim 7, wherein said CaO is proportioned with said coal in a ratio which is sufficient to provide 1 to 3 parts CaO per part sulfur in the coal.

9. A method according to claim 7, wherein said CaO is proportioned with said coal in a ratio which is sufficient to provide a stoichiometric relationship between the CaO and the sulfur in the coal.

10. A method according to claim 7, wherein said particulate coal and CaO have a size structure of about −65 mesh.

11. A method according to claim 1, wherein the heating of said pellets is a thermal treatment cycle conducted on a traveling grate machine.

12. A method according to claim 11, wherein the thermal treatment cycle includes a downdraft drying step at about 400° F., a downdraft firing step at between about 1700° F. and 2100° F., and an updraft cooling step at ambient temperatures.

13. A method according to claim 11, wherein the thermal treatment cycle includes a downdraft drying step at about 400° F., a downdraft firing step at between 1700° F. and 2100° F., and an updraft firing step.

* * * * *

UNITED STATES PATENT AND TRADEMARK OFFICE

CERTIFICATE OF CORRECTION

PATENT NO. : 4,111,755

DATED : September 5, 1978

INVENTOR(S) : Thomas E. Ban, Ashok D. Rao

It is certified that error appears in the above-identified patent and that said Letters Patent are hereby corrected as shown below:

Column 5, line 26, delete "Table II" and insert --Table III--.

Signed and Sealed this

*Eighteenth* Day of *September 1979*

[SEAL]

*Attest:*

*Attesting Officer*

LUTRELLE F. PARKER

*Acting Commissioner of Patents and Trademarks*